US005911842A

United States Patent [19]

Shiga et al.

[11] Patent Number: 5,911,842

[45] Date of Patent: Jun. 15, 1999

[54] HEAT RESISTING STEEL AND STEAM TURBINE ROTOR SHAFT AND METHOD OF MAKING THEREOF

[75] Inventors: Masao Shiga, Hitachi; Kishio Hidaka; Norio Yamada, both of Hitachiota; Shigeyoshi Nakamura, Hitachinaka; Yutaka Fukui, Hitachi; Nobuo Shimizu, Hitachi; Ryoichi Kaneko, Hitachi; Yasuhiro Harada; Yasuo Watanabe, both of Hitachinaka; Toshio Fujita, Tokyo; Norio Morisada, Hitachinaka; Yasuhiko Tanaka, Muroran, all of Japan

[73] Assignees: Hitachi, Ltd.; The Japane Steel Works, Ltd., both of Tokyo, Japan

[21] Appl. No.: 08/841,676

[22] Filed: Apr. 30, 1997

[30] Foreign Application Priority Data

May 7, 1996 [JP] Japan ..... 8-112228

[51] Int. Cl.[6] ..... C22C 38/30; C21D 9/30; C21D 8/10

[52] U.S. Cl. ..... 148/325; 148/605; 148/607; 148/663; 420/36

[58] Field of Search ..... 148/325, 605, 148/607, 663; 420/36, 37, 38

[56] References Cited

U.S. PATENT DOCUMENTS 4,844,755 7/1989 Hashimoto et al. .

4,917,738 4/1990 Takano et al. .

FOREIGN PATENT DOCUMENTS 384433 8/1990 European Pat. Off. .
639691 2/1995 European Pat. Off. .
691416 10/1996 European Pat. Off. .
4436874 4/1996 Germany .
B257-25629 5/1982 Japan .
59-179718 12/1984 Japan .

OTHER PUBLICATIONS

Key To Steels, 10 Edition 1974, Germany.

The Making, Shaping & Treating Steel, 10th Edition, 1985 p. 1287.

*Primary Examiner*—Deborah Yee
*Attorney, Agent, or Firm*—Fay, Sharpe, Beall, Fagan, Minnich & McKee

[57] ABSTRACT

A heat resisting steel whose metal structure is entirely martensite phase produced by tempering after quenching. The steel comprises, by weight, 0.05 to 0.20% C, not more than 0.15% Si, not more than 1.5% Mn, not more than 1.0% Ni, 8.5 to 13.0% Cr, not more than 3.50% Mo, not more than 3.5% W, 0.05 to 0.30% V, 0.01 to 0.20% Nb, not more than 5.0% Co, 0.001 to 0.020% boron, 0.005 to 0.040% nitrogen, 0.0005 to 0.0050% oxygen and 0.00001 to 0.0002% hydrogen. The steel has preferably not more than 10 of the Cr equivalent. The steel has 10 kgf/mm$^2$ or more of 100,000 hours creep rupture strength at 650° C.

14 Claims, 5 Drawing Sheets

HEAT RESISTING STEEL AND STEAM TURBINE ROTOR SHAFT AND METHOD OF MAKING THEREOF

BACKGROUND OF THE INVENTION

The present invention relates to a high strength heat resisting steel of a high temperature steam turbine in a thermal power plant of ultra supercritical pressure and a steam turbine rotor which is made of the heat resisting steel In recent years, with regard to thermal power generation plants, considerable attention has been paid to operating these plants under high temperature and high pressure with the goal of improving efficiency thereof, wherein it is intended to raise steam temperature of steam turbines up to 600° C. from the highest steam temperature of 566° C. at present, and finally up to 650° C. In order to raise the steam temperature, a heat resisting material is required, which has a high temperature strength greater than conventional ferritic heat resisting steel Austenitic heat resisting alloys are hardly applied to such use since they are inferior in thermal fatigue strength due to a large thermal expansion coefficient and expensive production cost, while some of them are excellent in high temperature strength.

Thus, recently there have been proposed many new ferritic heat resisting steels which are improved in high temperature strength, for example, in JP-A-62-103345, JP-A-62-60845, JP-A-60-165360, JP-A-60-165359, JP-A-60-165358, JP-A-63-89644, JP-A-62-297436, JP-A-62-297435, JP-A-61-231139 and JP-A-61-69948 in all of which one of the present inventors participated. Among those ferritic heat resisting steels, it is believed that a steel disclosed in JP-A-62-103345 has the highest strength.

There have been also proposed other heat resisting steels in JP-A-57-207161 and JP-B2-57-25629, which are intended to be improved by the present invention. The present inventors further proposed another heat resisting steel as shown in JP-A-4-147948.

However, in order to achieve the ultimate steam temperature of 650° C., those alloys mentioned above are not fully satisfactory, thus it has been desired to develop an available ferritic heat resisting steel having high strength at high temperature.

The heat resisting steel taught in JP-A-4-147948 is generally satisfactory. But, it has been found that, while the steel of JP' 948 has high strength at high temperature on the average, there is a large variance in high temperature strength and low temperature toughness thereof.

It is required to provide a rotor material which has 100,000 hours creep rupture strength of not less than 10 kgf/mm$^2$ at 650° C. in order to realize a thermal power plant of ultra supercritical pressure which is operated under the ultimate steam temperature of 650° C. The rotor material is also required to be excellent in toughness property and brittleness resistance property in the view point of keeping safety against brittle fracture.

SUMMARY OF THE INVENTION

An object of the present invention is to provide a heat resisting steel and a steam turbine rotor shaft which are more excellent in high temperature strength than those of a conventional type.

The present inventors reviewed conventional alloys and studied an optimum amount of respective additive elements in a heat resisting steel in order to further strengthen the same. As a result thereof, it was found that the heat resisting steel can be considerably improved by positively adding a comparatively larger amount of Co than that in similar conventional alloys and further adding a larger amount of W (tungsten) than that in the above conventional alloys together with Mo, attaching more importance to W than Mo. Such remarkable effect is primarily owing to synergism by W and Co.

The inventors further found that the heat resisting steel can have stable high strength at high temperature and high toughness at low temperature by controlling the respective amounts of B (boron), nitrogen, oxygen and hydrogen within an appropriate range. The present invention is also based on this new recognition.

According to a first aspect of the invention, there is provided a heat resisting steel excellent in high temperature strength, whose metal structure is entirely martensite phase produced by tempering after quenching, and which comprises, by weight, 0.05 to 0.20% C, not more than 0.15% Si, not more than 1.5% Mn, not more than 1.0% Ni, 8.5 to 13.0% Cr, not more than 3.5% Mo, preferably from 0.05 to less than 0.50% or from more than 0.5 to not more than 3.5%, 1.0 to 3.5% W, 0.05 to 0.30% V, 0.01 to 0.20% Nb, not more than 5.0% Co, 0.001 to 0.020% boron, 0.005 to 0.040% nitrogen, not more than 0.010% oxygen and not more than 0.00020% hydrogen. The component elements are preferably controlled such that the heat resisting steel has the Cr equivalent of not more than 8.5, where the Cr equivalent is defined by weight as follows:

$$\text{"Cr equivalent} = -40\times C - 30\times N - 2\times Mn - 4\times Ni + Cr + 6\times Si + 4\times Mo + 1.5W + 11\times V + 5\times Nb - 2\times Co\text{"}$$

According to a second aspect of the invention, there is provided a steam turbine rotor shaft which is made of the heat resisting martensitic steel mentioned above.

According to a third aspect of the invention, there is provided a heat resisting steel whose metal structure is entirely martensite phase produced by tempering after quenching, and which comprises, by weight, 0.08 to 0.16% C, not more than 0.10% Si, 0.15 to 0.85% Mn, 0.20 to 0.80% Ni, 10.0 to 12.0% Cr, 0.05 to 0.50% Mo, 2.0 to 3.0% W, 0.10 to 0.30% V, 0.03 to 0.10% Nb, 2.0 to 3.5% Co, 0.004 to 0.017% boron, 0.010 to 0.030% nitrogen, 0.0005 to 0.0035% oxygen and 0.00001 to 0.00015% hydrogen. The Cr equivalent thereof is preferably controlled to not more than 8.5.

According to a fourth aspect of the invention, there is provided a rotor shaft which is made of the heat resisting ferritic steel mentioned in the above paragraph of the third aspect and which can be utilized in a thermal power plant of ultra supercritical pressure which is operated under a steam temperature of not less than 610° C.

According to a fifth aspect of the invention, there is provided a rotor shaft which is made of the heat resisting ferritic steels mentioned in the above paragraphs of the first and the third aspects and which has 100,000 hours creep rupture strength of not less than 10 kgf/mm$^2$ at 650° C.

According to a sixth aspect of the invention, there is provided a heat treatment method for a steam turbine rotor shaft, which comprises the steps of: quenching a starting material of said rotor shaft from a temperature of 1,000 to 1,100° C.; tempering the quenched material optionally followed by secondary tempering; forming a center hole in the tempered material along the axis thereof; and further tempering the material provided with said center hole.

According to a seventh aspect of the invention, the above heat resisting steels comprise boron and nitrogen in a total amount of not more than 0.050%, respectively, wherein a ratio of N/B is 1 to 5, where "N" is nitrogen and "B" is boron.

According to an eighth aspect of the invention, there is provided a steam turbine rotor shaft which is made of the heat resisting steel mentioned in the above paragraph of the seventh aspect.

According to a ninth aspect of the invention, the above heat resisting steel mentioned in the paragraph of the third aspect comprise boron and nitrogen in a total amount of not more than 0.035%, wherein a ratio of N/B is 1 to 5, where "N" is nitrogen and "B" is boron.

According to a tenth aspect of the invention, there is provided a steam turbine rotor shaft which is made of the heat resisting steel mentioned in the above paragraph of the first, third or seventh aspects and which is operated under a steam temperature of not less than 610° C.

According to an eleventh aspect of the invention, the above heat resisting steel mentioned in the paragraph of the first, third or seventh aspects has 100,000 hours creep rupture strength of not less than 10 kgf/mm$^2$ at 650° C. and the impact absorption energy of not less than 2 kgf-m at 20° C. after heating for 1,000 hours at 650° C.

According to a twelfth aspect of the invention, there is provided a steam turbine rotor shaft which is made of the heat resisting steel mentioned in the above paragraph of the eleventh aspect.

The respective heat resisting steels mentioned in the above paragraphs of the first, third, seventh, ninth and eleventh aspects may comprise, by weight, not more than 0.2% in the aggregate of at least one element selected from Ca, Ti, Zr, Ta, Hf, Mg and rare earth elements.

DETAILED DESCRIPTION OF THE INVENTION

Figure 1:
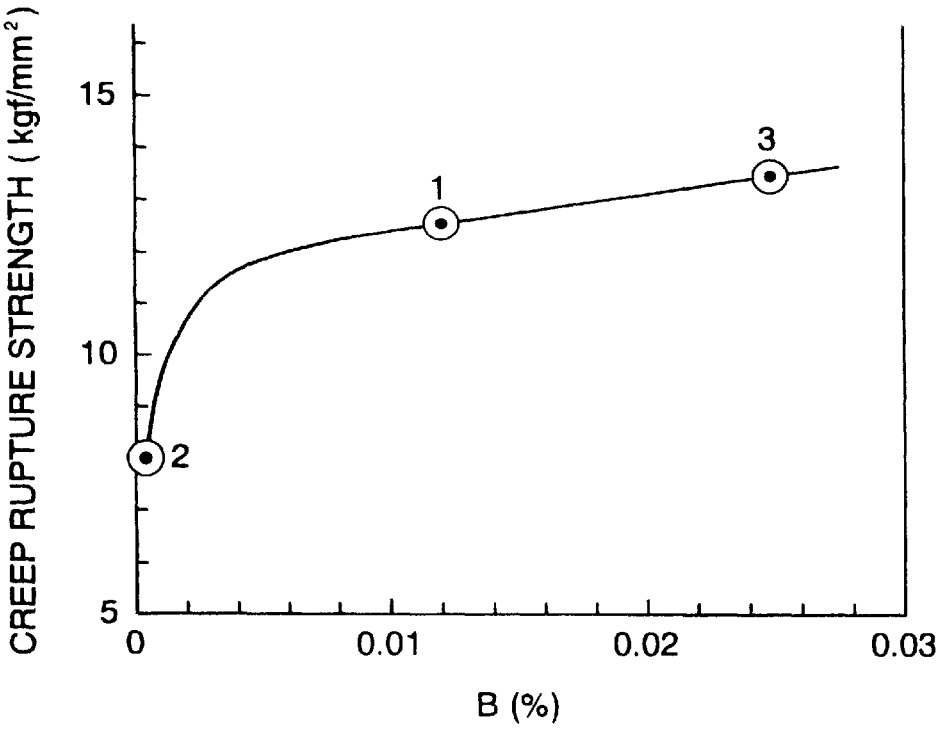
FIG. 1 shows a graph which shows the effect of boron on 100,000 hours creep rupture strength at 650° C.
Figure 2:
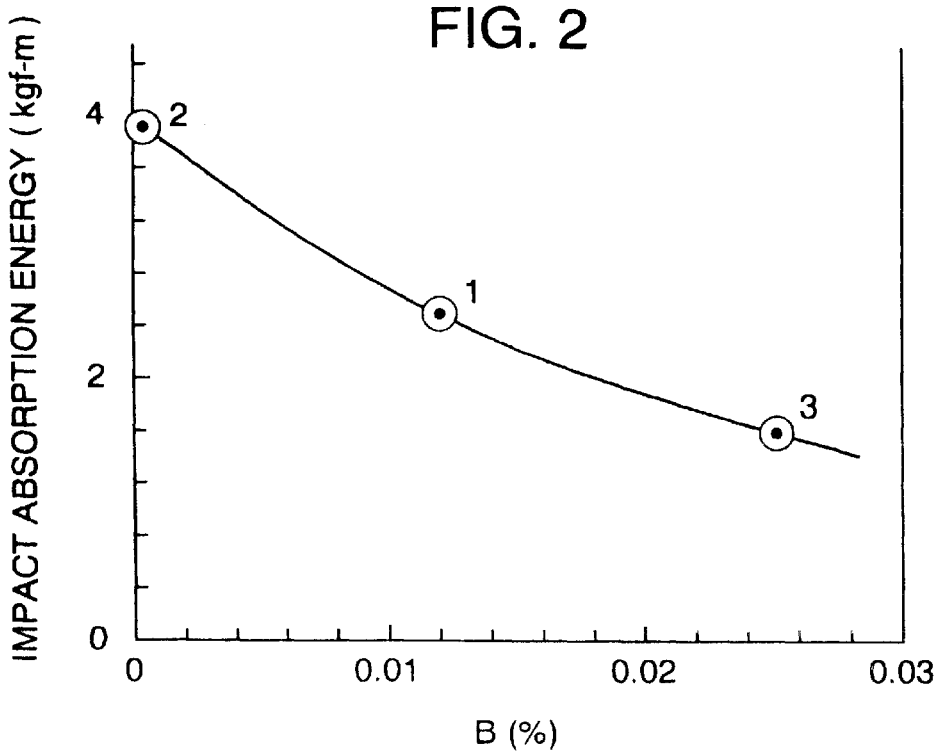
FIG. 2 shows a graph which shows the effect of boron on impact absorption energy at 20° C.

Ten types of known alloys disclosed in the above noted documents from JP-A-62-103345 through JP-A-61-69948 do not comprise Co or comprise only not more than 1% Co. Conventionally, it has been generally believed that a larger amount of Co is inappropriate for tungsten containing steels which are liable to be deteriorated especially in ductility, since the Charpy impact value of steel may be deteriorated by Co according to general knowledge. But, according to the research of the present inventors, it was found that there is no such unfavorable tendency caused by additional Co and that, in contrast, high temperature strength and toughness are significantly improved by the addition of not less than 2.0% Co. Thus, in the steel of the present invention, it is possible to considerably improve high temperature strength thereof by adding 2.1% Co.

An alloy disclosed in JP-A-57-207161 comprises 0.5 to 2.0% Mo, 1.0 to 2.5% W, 0.3 to 2.0% Co, in which Mo and W are regarded as identically important alloying elements, and Co is controlled to a comparatively low amount. In contrast, the invention steels comprise a lower amount of Mo than the Mo amount range of JP' 161 alloy, in which W is regarded as rather important and high temperature strength is further improved by synergism of higher amounts of additive W and Co.

JP-A-57-25629 teaches a material for a combustion chamber of an internal combustion engine, especially a casting material which is directed to improving thermal fatigue resistance property thereof. Thus, in the material of JP' 629, Si is positively added in a range of 0.2 to 3.0% as an effective deoxidizer and also in order to improve fluidity of molten metal during casting and oxidation property in high temperature. The material is different from the alloys of the present invention with regard to those chemical compositions and applications. The alloys of the present invention are quite different from the material of JP' 629 in the point that, in the alloys of the present invention, Si is a detrimental element and must be restricted to not more than 0.15%.

JP-A-57-25629 also teaches that Mo, W, Nb, V and Ti are identical to one another as alloying elements with regard to those effects, thus the material may comprise at least one of those elements. Contrasting, in the alloys of the present invention, since Mo, W, Nb and V have different functions, respectively, it is necessary for the alloys to comprise all of those elements. This means that the technical idea of the invention is quite different from that of JP' 629. With respect to such difference in the alloy compositions of the JP' 629 material and the alloys of the present invention, the former has a maximum creep rupture strength of 12.5 kgf/mm$^2$ for 100 hours at 700° C., whereas the latter have that of not lower than 15 kgf/mm$^2$ thereby it has been realized to improve alloy strength by the invention.

Further, in the case where the invention steel of the present invention controlled amounts of 0.001 to 0.020% boron, 0.005 to 0.040% nitrogen, 0.0005 to 0.0050% oxygen and 0.00001 to 0.00020% hydrogen, it is possible to obtain 100,000 hours creep rupture strength of not less than 10 kgf/mm$^2$ at 650° C. which is required for the rotor shaft of the ultra supercritical pressure turbine. By such control in the chemical composition, the steel of the present invention can have high toughness in low temperature of impact absorption energy of 2 kgf-m at 20° C. even after embrittlement treatment for 1,000 hours at 650° C.

In the steel of the present invention, high temperature strength and low temperature toughness can be raised by adding at least one of carbide forming elements such as Ti, Zr, Hf and so on in amount or aggregation amount of not more than 0.5% and at least one of Ca, Mg, Al and rare earth elements including La, Ce, Y and so on in amount or aggregation amount of not more than 0.2%. Especially, not more than 0.2% Ti and not more than 0.2% Hf are preferable.

The followings are reasons why the specified amount range of the respective alloying elements is preferred.

Carbon (C) is an indispensable element for the steel of the present invention in order to keep quenching property and raise high temperature strength by precipitating $M_{23}C_6$ type carbides during tempering treatment. While the steel of the present invention requires at least 0.05% carbon, in the case of exceeding 0.20% carbon, an excess amount of $M_{23}C_6$ type carbides are precipitated, whereby the matrix is deteriorated in strength so as to reduce high temperature strength of steel in a long time use. Thus, carbon is limited to an amount range of 0.05 to 0.20%, preferably 0.08 to 0.16% and more desirably 0.09 to 0.14%.

Mn is necessary for the steel of the present invention in order to restrain formation of the δ-ferrite phase and promote precipitation of $M_{23}C_6$ type carbides. It is limited to an amount range of not more than 1.5% since an excess amount of more than 1.5% Mn deteriorates oxidation resistance and brittleness resistance properties of the steel. A preferred amount range of Mn is 0.15 to 0.85%, more preferably 0.35 to 0.65%.

Ni restrains formation of the δ-ferrite phase and raises toughness of the steel of the present invention. More than 1.0% Ni deteriorates the steel in creep rupture strength. Thus, Ni is limited to an amount of not more than 1.0%, preferably 0.2 to 0.8% and more desirably 0.4 to 0.6%.

Cr is indispensable for the steel of the present invention in order to provide oxidation resistance and precipitate $M_{23}C_6$ type carbides so as to raise high temperature strength. While the invention steel requires at least 8.5% Cr, in the case of exceeding 13% Cr, the δ-ferrite phase is formed, whereby the steel is deteriorated in high temperature strength and toughness. Thus, Cr is limited to an amount range of 8.5 to 13.0%, preferably 10.0 to 12.0% and more desirably 10.5 to 11.5%.

Mo promotes fine precipitation of $M_{23}C_6$ type carbides while preventing aggregation thereof. Thus, it is effective to maintain high temperature strength of the steel of the present invention for a long time. However, in the case of exceeding 3.50% Mo, the δ-ferrite phase is liable to be formed, therefore Mo is limited to an amount of not more than 3.5%, preferably 0.15 to 0.25% or more than 0.5 to not more than 3.5% and more desirably 0.55 to 0.85% or 1.2 to 2.5%.

Tungsten (W) more effectively restrains $M_{23}C_6$ type carbides to aggregate to become coarse than Mo and is effective for improving high temperature strength of the steel since tungsten dissolves in the matrix to strengthen it. While the steel of the present invention requires not more than 3.5% W, in the case of exceeding 3.5% W, the δ-ferrite phase and the Laves phase ($Fe_2W$) are liable to be formed, whereby the steel is deteriorated in high temperature strength. Thus, tungsten is limited to an amount of not more than 3.5%, preferably 0.5 to 1.0% in the case of the Mo amount of 1.2 to 2.5%, 1.6 to 3.0% in the case of the Mo amount of less than 1.2%, and more desirably 2.0 to 2.8%.

Vanadium (V) is effective for precipitating carbo-nitrides thereof in the steel matrix to raise high temperature strength. While the steel of the present invention requires at least 0.05% V, in the case of exceeding 0.3% V, carbon is excessively fixed by V and precipitates of $M_{23}C_6$ type carbides are reduced in amount to deteriorate high temperature strength of the steel. Thus, vanadium is limited to an amount range of 0.05 to 0.3%, preferably 0.10 to 0.30% and more desirably 0.15 to 0.25%.

Nb forms NbC to refine crystal grains of the steel, and a part thereof is dissolved in the matrix when quenched and precipitated during tempering to raise high temperature strength. While the steel of the present invention requires at least 0.01% V, in the case of exceeding 0.20% Nb, is excessively fixed by Nb and precipitates of $M_{23}C_6$ type carbides are reduced in amount to deteriorate high temperature strength of the steel. Thus, Nb is limited to an amount range of 0.01 to 0.20%, preferably 0.03 to 0.13% and more desirably 0.04 to 0.10%.

Co is an important alloying element by which the steel of the present invention is characterized in distinguishing it from conventional steels and significantly improved in high temperature strength of the steel. It is believed that such effect is probably owing to a cooperative action of Co and tungsten with respect to the particular chemical composition of the steel of the present invention comprising not less than 1.6% tungsten. In order to more clearly realize such Co effect, preferably the steel of the present invention comprises at least 2.0% Co. On the other hand, in the case of an excess amount of Co, the steel of the present invention is deteriorated in ductility and caused to become expensive in the production cost. Thus, Co is limited up to 5.0%, preferably 2.1 to 3.5% and more desirably 2.2 to 3.1%.

Nitrogen (N) is effective for precipitating vanadium nitrides and raising high temperature strength of the steel in the form of solid solution by the so called "IS effect" in cooperation with Mo and tungsten, the IS effect being of an interaction between an interstitial solvent element and a substitution type solvent element. While the steel of the present invention requires at least 0.005% nitrogen, in the case of exceeding 0.04% nitrogen, the steel is deteriorated in ductility and toughness. Thus, nitrogen is limited to an amount range of 0.005 to 0.04%, preferably 0.01 to 0.03% and more desirably 0.015 to 0.025%.

Si is a detrimental element, which promotes formation of the Laves phase and deteriorates the steel in toughness due to grainboundary segregation thereof and so on. Thus, Si is limited to an amount of not more than 0.15%, preferably not more than 0.10% and more desirably not more than 0.06%. While Si is usually added in the steel as a deoxidizer, in the case where the steel is deoxidized under vacuum, it is not added thereto. In the latter case, the steel comprises not more than 0.01% Si, preferably 0.005 to 0.06%.

Boron (B) has the grain boundary strengthening effect and the carbide dispersion strengthening effect in the steel so as to raise high temperature strength, the latter effect being owing to that boron produces precipitates of $M_{23}(CB)_6$ which are more stable in high temperature than $M_{23}C_6$ type carbides and which prevent carbides to aggregate and be coarsened. While at least 0.001% B is effective for obtaining such effects, in the case of exceeding 0.020% B, the steel is deteriorated in weldability, forging ability and low temperature toughness. Thus, boron is limited to an amount range of 0.001 to 0.020%, preferably not less than 0.002%, more preferably 0.004 to 0.017% and more desirably 0.006 to 0.013%.

Boron and nitrogen are closely connected with each other. It is preferred to control amounts thereof such that the amount ratio "N/B" is 1 to 5 and the aggregation thereof is not more than 0.050%. Especially, with regard to the aggregation amount, it is noted that, in the case of not less than 0.010% boron or less than 0.015% nitrogen, not more than 0.050% is preferred, and in the case of less than 0.010% boron or not less than 0.015% nitrogen, not more than 0.040% is preferred. The aggregation amount is more preferably not less than 0.015% and further desirably 0.015 to 0.035%.

The solubility of oxygen in steel is at most 0.001%, but actually steel comprises an excess amount of oxygen to form nonmetallic compounds including MnO-SiO2. While oxygen has an effect of preventing coarsening of crystal grains of steel, an excess amount thereof deteriorates the steel of the present invention in creep rupture strength and rupture toughness. Thus, oxygen is limited up to 0.010%, preferably 0.0050%, more preferably 0.0005 to 0.0035% and more desirably 0.0005 to 0.0020%.

Hydrogen exists in steel as an interstitial solvent because of the small atomic radius. Further, while it has been well known that hydrogen is responsible for formation of defects in steel, such as white spots, it can not be completely eliminated from steel by the current industrial technology. Since an excess amount of more than 0.00020% hydrogen deteriorates the invention steel in creep rupture strength and rupture toughness, hydrogen is limited up to 0.0002%, preferably 0.00001 to 0.00015% and more preferably 0.00001 to 0.00010%.

Regarding the Cr equivalent, if it is more than 10, the detrimental δ-ferrite phase, which deteriorates the steel in low temperature toughness, brittleness resistance property and fatigue strength, is precipitated in the steel, thus it is limited to not more than 10, preferably not more than 8.5 and more preferably not more than 7.5.

The rotor shaft of the present invention is produced by the following steps: casting an ingot from a molten metal of the steel of the present invention which is melted in an electric furnace or by the electro-slag remelting method (ESR); forging the ingot; heating the forged product up to 900° C. to 1150° C.; quenching the forged product after heating in a cooling rate of 50° C./hour to 600° C./hour at the central region of the product; tempering the quenched product at 500° C. to 700° C. (: a primary tempering) optionally followed by secondary tempering at 600° C. to 750° C.; forming a center hole in the tempered product along the axis thereof; and further tempering the product provided with the center hole (: a final tempering). The tempering is conducted at not lower than 200° C., preferably 500° C. to 700° C. The final tempering is conducted at a temperature higher than that of the first tempering and lower than that of the optional tempering. Especially, the steel of the present invention and the rotor shaft of the present invention can have high strength and high toughness by the quenching cooling rate of 50° C./hour to 600° C./hour at the central region of the product to be processed.

EXAMPLE

Example 1

The alloys having the chemical compositions shown in Table 1 were melted by a vacuum induction melting method, respectively. They were cast to ingots each having a weight of 50 kg and forged to produce rectangular bars each having a cross sectional dimension of 30 mm×90 mm. The forged products were subjected to a heat treatment, respectively, which corresponds to that of the central region of an actual large steam turbine rotor.

TABLE 1

| Example | Chemical Composition (wt %) | | | | | | | | | | | | | | | Cr | | B + |
|---|---|---|---|---|---|---|---|---|---|---|---|---|---|---|---|---|---|---|
| No. | Fe | C | Si | Mn | Ni | Cr | Mo | W | V | Nb | Co | B | N | O | H | equivalent | N/B | N |
| 1 | Bal. | 0.10 | 0.04 | 0.49 | 0.50 | 10.95 | 0.18 | 2.61 | 0.22 | 0.06 | 2.54 | 0.012 | 0.020 | 0.0038 | 0.00010 | 5.9 | 1.67 | 0.032 |
| 2 | " | 0.10 | 0.04 | 0.48 | 0.52 | 10.99 | 0.22 | 2.65 | 0.22 | 0.07 | 2.56 | 0.001 | 0.018 | 0.004 | 0.00080 | 6.2 | 18 | 0.019 |
| 3 | " | 0.10 | 0.03 | 0.48 | 0.48 | 11.00 | 0.22 | 2.58 | 0.20 | 0.06 | 2.60 | 0.025 | 0.023 | 0.004 | 0.00080 | 5.7 | 0.92 | 0.048 |
| 4 | " | 0.11 | 0.05 | 0.50 | 0.50 | 11.03 | 0.18 | 2.48 | 0.18 | 0.05 | 2.41 | 0.010 | 0.002 | 0.0041 | 0.00012 | 7 | 0.20 | 0.012 |
| 5 | " | 0.09 | 0.04 | 0.55 | 0.51 | 10.97 | 0.19 | 2.41 | 0.19 | 0.05 | 2.62 | 0.012 | 0.062 | 0.0038 | 0.00011 | 4.1 | 5.17 | 0.074 |
| 11 | " | 0.11 | 0.05 | 0.50 | 0.48 | 11.03 | 0.21 | 2.58 | 0.20 | 0.05 | 2.48 | 0.011 | 0.018 | 0.0041 | 0.00013 | 5.7 | 1.64 | 0.029 |
| 12 | " | 0.12 | 0.05 | 0.48 | 0.48 | 11.03 | 0.21 | 2.70 | 0.21 | 0.06 | 2.60 | 0.013 | 0.024 | 0.0040 | 0.00022 | 5.2 | 1.85 | 0.037 |
| 13 | " | 0.11 | 0.04 | 0.43 | 0.49 | 11.11 | 0.21 | 2.65 | 0.21 | 0.07 | 2.54 | 0.013 | 0.025 | 0.0038 | 0.00030 | 5.8 | 1.92 | 0.038 |
| 14 | " | 0.10 | 0.03 | 0.40 | 0.52 | 11.00 | 0.18 | 2.62 | 0.20 | 0.07 | 2.50 | 0.012 | 0.023 | 0.0020 | 0.00011 | 5.8 | 1.92 | 0.035 |
| 15 | " | 0.09 | 0.05 | 0.49 | 0.51 | 11.08 | 0.21 | 2.70 | 0.19 | 0.08 | 2.47 | 0.011 | 0.020 | 0.0130 | 0.00012 | 6.6 | 1.82 | 0.031 |
| 16 | " | 0.11 | 0.04 | 0.50 | 0.51 | 11.07 | 0.20 | 2.49 | 0.18 | 0.06 | 2.52 | 0.012 | 0.019 | 0.0220 | 0.00010 | 5.1 | 1.58 | 0.031 |
| 17 | " | 0.10 | 0.04 | 0.48 | 0.51 | 10.94 | 0.18 | 2.60 | 0.22 | 0.06 | 2.53 | 0.012 | 0.020 | 0.0038 | 0.00010 | 5.9 | 1.67 | 0.032 |
| 21 | " | 0.17 | 0.30 | 0.57 | 0.56 | 11.05 | 1.05 | — | 0.20 | 0.08 | — | — | 0.065 | — | — | 7.5 | — | — |

*Note: Cr equivalent = Cr + 6Si + 4Mo + 1.5W + 11V + 5Nb − 40C − 2Mn − 4Ni − 2Co − 30N Examples No. 1 to 17 were subjected to quenching treatment at a cooling rate of 100° C./hour after keeping at 1050° C. for 5 hours, a first tempering treatment of 570° C. for 20 hours, a secondary tempering treatment of 710° C. for 20 hours, and a ternary tempering treatment of 680° C. for 20 hours.

Example No. 21 was subjected to quenching treatment at a cooling rate of 100° C./hour after keeping at 1050° C. for 5 hours, a first tempering treatment of 570° C. for 20 hours, and a secondary tempering treatment of 670° C. for 20 hours.

Specimens were taken from the above heat treated materials, respectively, and subjected to the creep rupture test at 650° C. and 700° C. The test results were evaluated by means of the Larson-Miller method to determine 100,000 hours creep rupture strength at 650° C. with regard to the respective specimens.

With respect to the impact test, the above heat treated materials were subjected to an embrittlement treatment at 650° C. for 1000 hours, respectively, and thereafter V-notch Charpy test specimens were taken from them in accordance with JIS Z 2202 No. 4. The specimens were subjected to the V-notch Charpy test at 20° C. and an impact absorption energy was determined with regard to the respective specimens.

In Table 1, Examples No. 1, 11, 14 and 17 are of the steel of the present invention, No. 2 to 5, 12, 13, 15 and 16 are of the comparative steel, and No. 21 is of a conventional rotor material which has been widely used in current turbines.

Table 2 shows the 100,000 hours creep rupture strength at 650° C. and the impact absorption energy of the respective Examples.

TABLE 2

| Specimen | Chemical Composition | | | | 650° C., 100,000 h Creep Rupture Strength | 20° C., Impact Absorption |
|---|---|---|---|---|---|---|
| No. | B | N | O | H | (kgf/mm$^2$) | Energy (kgf-m) |
| 1 | 0.012 | 0.020 | 0.0038 | 0.00010 | 12.5 | 2.5 |
| 2 | 0.001 | 0.018 | 0.004 | 0.00080 | 8.0 | 3.9 |
| 3 | 0.025 | 0.023 | 0.004 | 0.00080 | 13.4 | 1.6 |
| 4 | 0.010 | 0.002 | 0.0041 | 0.00012 | 7.2 | 2.6 |
| 5 | 0.012 | 0.062 | 0.0038 | 0.00011 | 7.0 | 1.0 |
| 11 | 0.011 | 0.018 | 0.0041 | 0.00013 | 11.5 | 2.6 |
| 12 | 0.013 | 0.024 | 0.0040 | 0.00022 | 9.8 | 1.5 |
| 13 | 0.013 | 0.025 | 0.0038 | 0.00030 | 9.5 | 1.2 |
| 14 | 0.012 | 0.023 | 0.0020 | 0.00011 | 12.5 | 2.8 |
| 15 | 0.011 | 0.020 | 0.0130 | 0.00012 | 8.6 | 1.6 |
| 16 | 0.012 | 0.019 | 0.0220 | 0.00010 | 7.2 | 1.5 |
| 17 | 0.012 | 0.020 | 0.0038 | 0.00010 | 12.7 | 3.2 |
| 21 | — | 0.065 | — | — | 4.0 | 2.6 |

The steel of the present invention Examples No. 1, 11, 14 and 17 have 11.5 to 12.7 kgf/mm$^2$ of 100,000 hours creep rupture strength at 650° C. which are remarkably excellent and about three times that of the conventional material of No. 21. Further, Examples No. 1, 11, 14 and 17 of the steel of the present invention have 2.5 to 3.2 kgf-m (at 20° C.) of toughness which are generally equal to or greater than that of the conventional material.

It is believed that the steel of the present invention is applicable to a rotor of the ultra supercritical pressure steam turbine which is operated under the ultimate steam temperature of 650° C.

FIGS. 1 to 8 show the test results of mechanical properties of the Examples.

From those drawings, the following can be recognized.

While additive boron deteriorates the toughness (FIG. 2), it remarkably raises the creep rupture strength (FIG. 1). By adding not less than 0.001% boron, not less than 10 kgf/mm$^2$ of 100,000 hours creep rupture strength at 650° C. can be obtained. However, an excess amount of boron deteriorates the toughness, especially more than 0.02% of boron makes the impact absorption energy less than 2 kgf-m.

Figure 3:
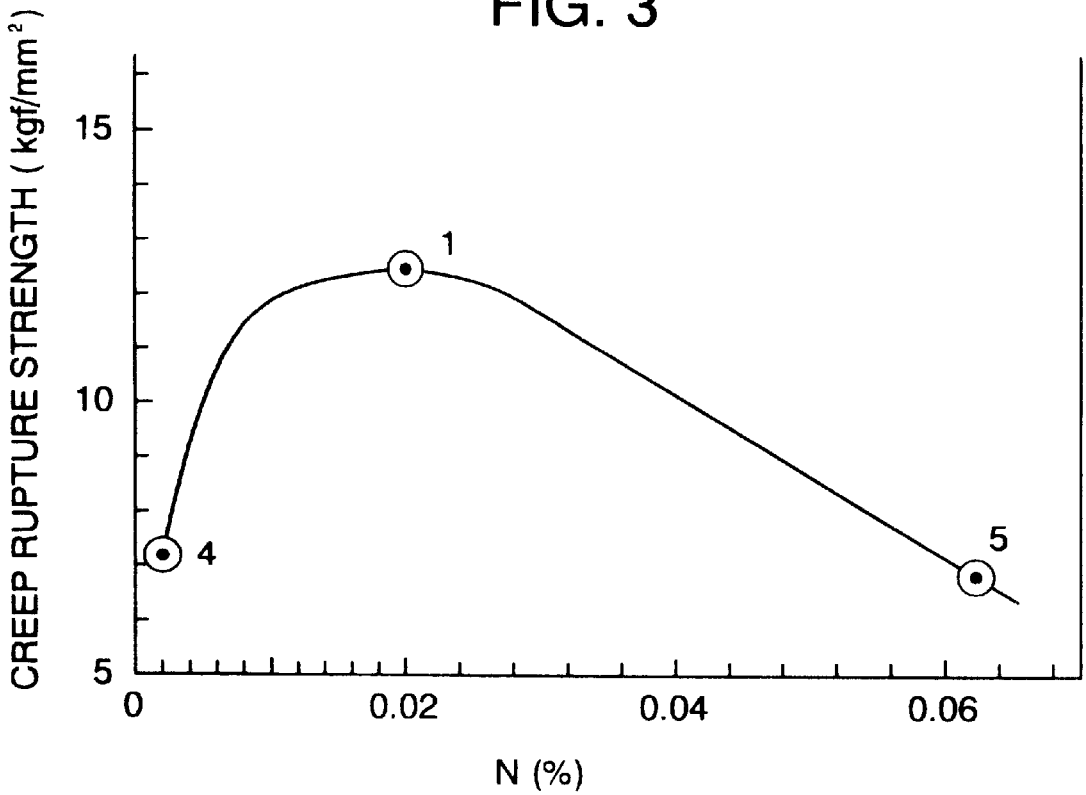
FIG. 3 shows a graph which shows the effect of nitrogen on 100,000 hours creep rupture strength at 650° C.
Figure 4:
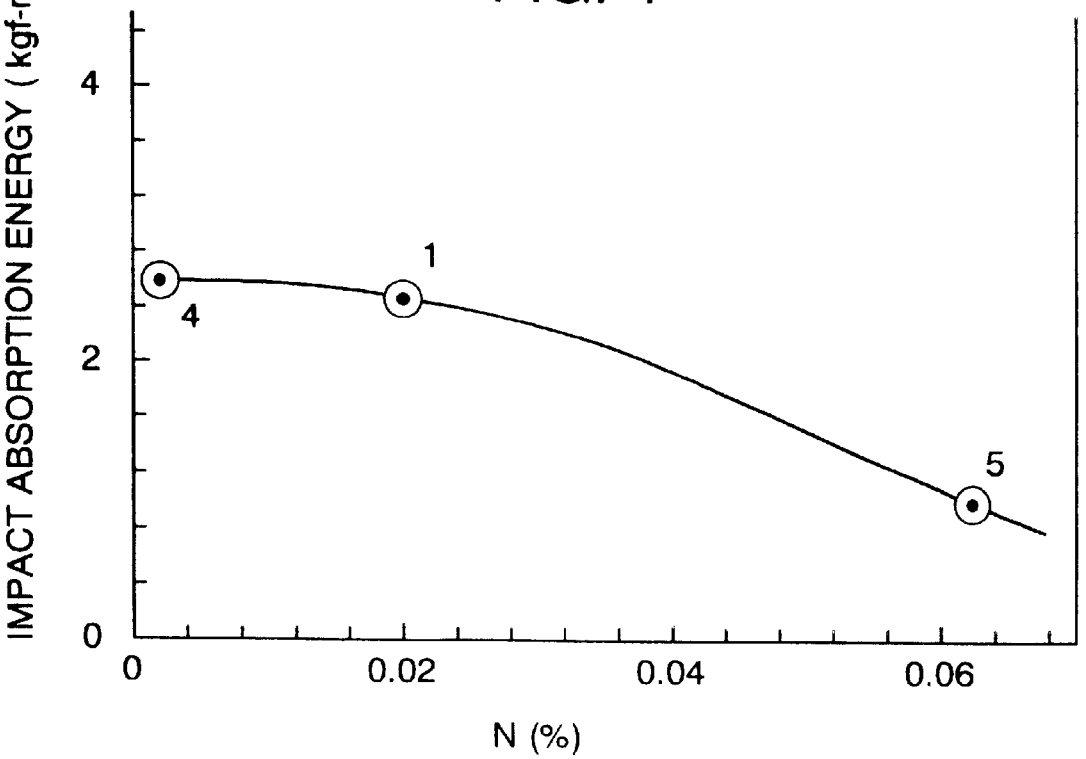
FIG. 4 shows a graph which shows the effect of nitrogen on impact absorption energy at 20° C.

While nitrogen in the steels deteriorates the toughness (FIG. 4), around 0.02% nitrogen remarkably raises the creep rupture strength (FIG. 3). By adding 0.005 to 0.04% nitrogen, not less than 10 kgf/mm$^2$ of 100,000 hours creep rupture strength at 650° C. can be obtained.

Figure 5:
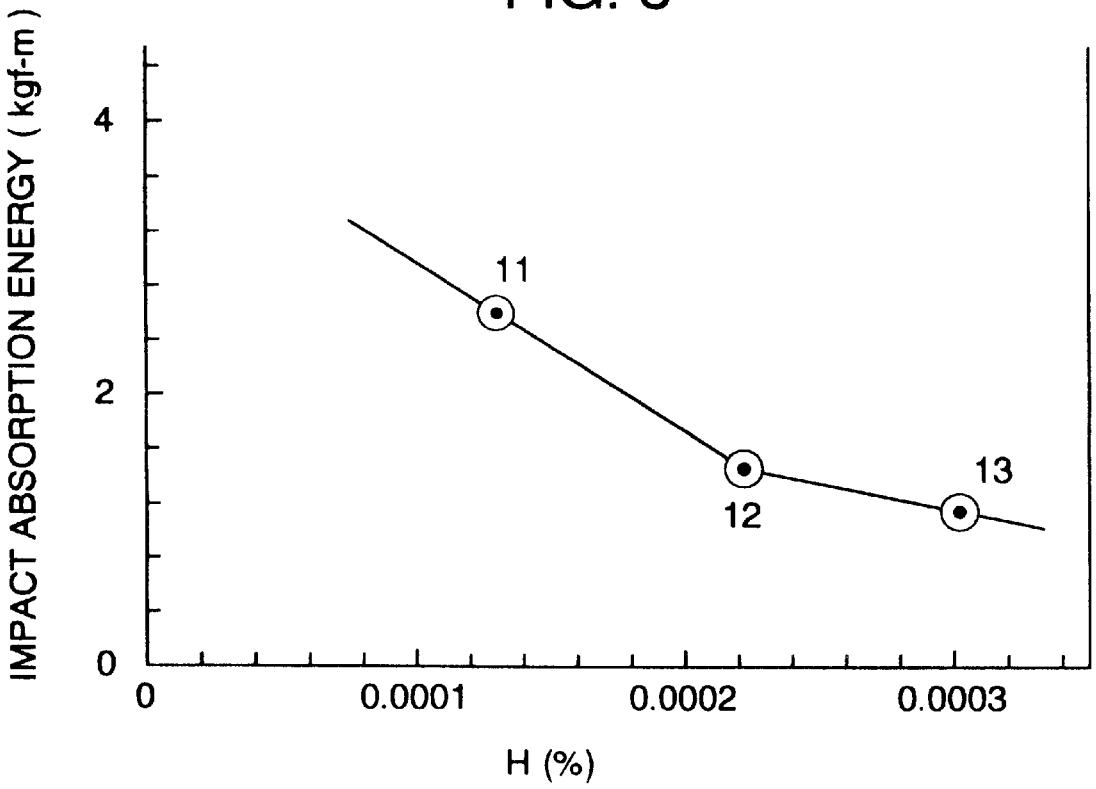
FIG. 5 shows a graph which shows the effect of hydrogen on impact absorption energy at 20° C.

An increase of hydrogen deteriorates the toughness (FIG. 5). If hydrogen is in an amount of more than 0.0002%, it is impossible to keep not less than 10 kgf/mm$^2$ of 100,000 hours creep rupture strength at 650° C. and not less than 2 kgf-m of impact absorption energy.

Figure 6:
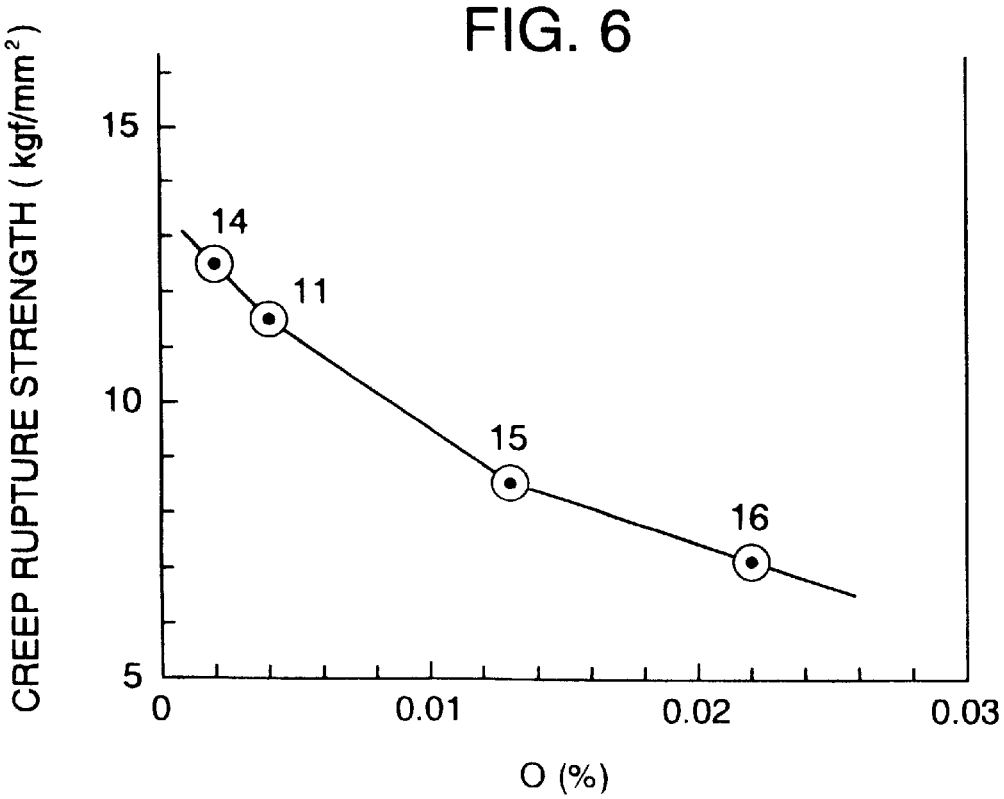
FIG. 6 shows a graph which shows the effect of oxygen on 100,000 hours creep rupture strength at 650° C.
Figure 7:
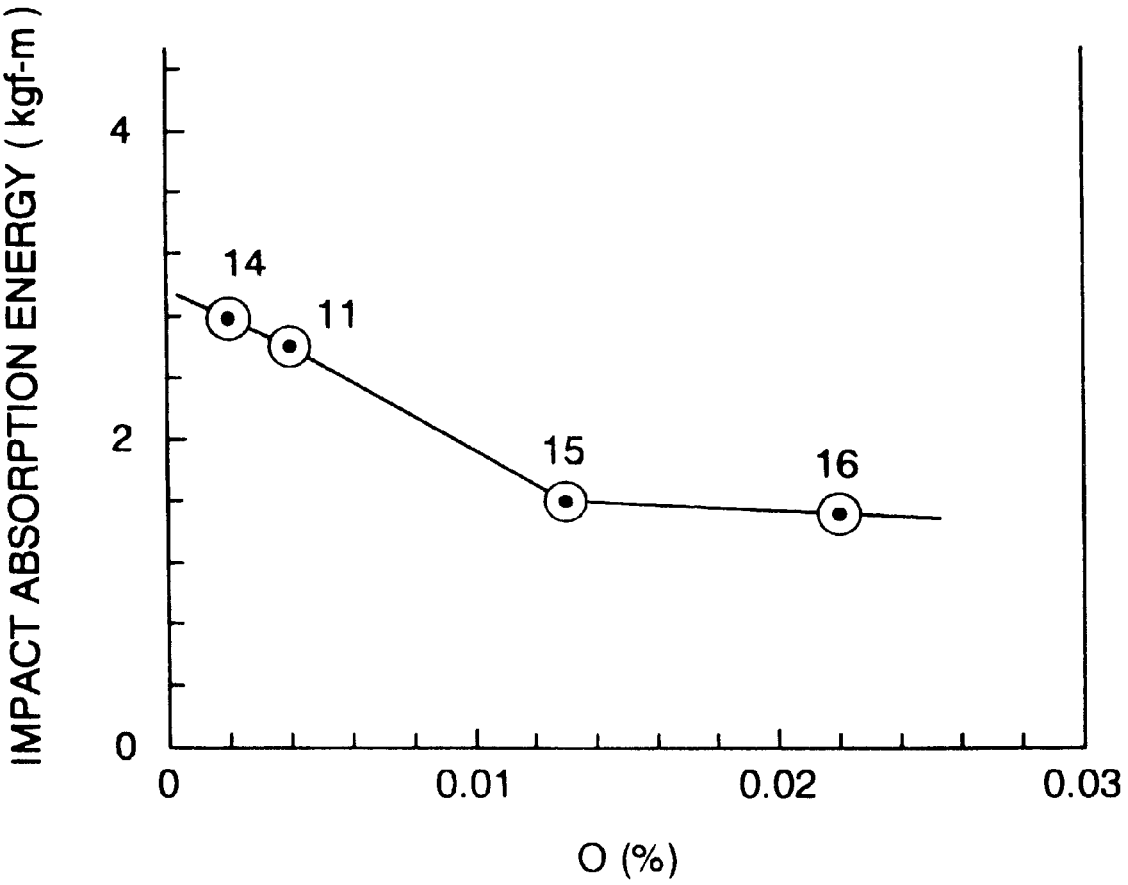
FIG. 7 shows a graph which shows the effect of oxygen on impact absorption energy at 20° C.
Figure 8:
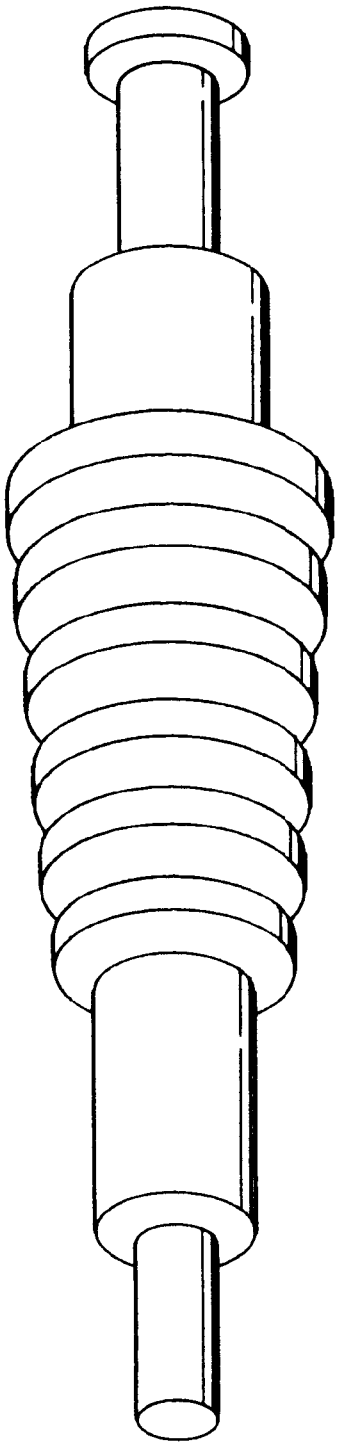
FIG. 8 shows a perspective view of a steam turbine rotor shaft according to the invention.

An increase of oxygen deteriorates the creep rupture strength and the toughness (FIGS. 6 and 7). If oxygen is in an amount of not less than 0.005%, it is impossible to keep not less than 10 kgf/mm$^2$ of 100,000 hours creep rupture strength at 650° C.

Example 2

A material which has the chemical composition of Example No. 17 shown in Table 1 was melted in an electric furnace. An ingot from the melt was forged to obtain an electrode bar. Subsequently the electrode bar was subjected to the electro-slag remelting process. The obtained product from the electro-slag remelting process was forged at 1150° C. to produce an article of a rotor shape which has a maximum diameter of about 900 mm and a length of 4500 mm and thereafter subjected to rough machining. The thus obtained product was subjected to heat treatments of quenching and thrice tempering which are the same conditions as those in Example 1. In order for dehydrogenation, the ternary tempering was conducted after forming a center hole having a diameter of 90 mm in the product just after the secondary tempering treatment.

Regarding Example No. 17, Table 1 shows the result of chemical analysis of the central portion of the product having the rotor shaft shape which was already subjected to the above heat treatments.

Table 2 shows the results of the creep rupture test and the V-notch Charpy test with regard to the product having the rotor shaft shape. The results are approximately identical to those of the steel of the present invention in embodiment 1.

From the Example, it was proved that the steel of the present invention is applicable to a rotor of a large turbine without any problems on fabricability.

As will be apparent from the above, according to the steel of the present invention, when it is applied to a rotor shaft of an ultra supercritical pressure steam turbine, the steam temperature thereof can be raised up to about 650° C., whereby the thermal efficiency in a thermal power plant will be remarkably improved.

What is claimed is:

1. A heat resisting steel whose metal structure is entirely martensite phase produced by tempering after quenching, and which comprises, by weight, 0.05 to 0.20% C, not more than 0.10% Si, from more than 0.15 to 0.85% Mn, not more than 1.0% Ni, 8.5 to 13.0% Cr, not more than 3.50% No, not more than 3.5% W, 0.05 to 0.30% V, 0.01 to 0.20% Nb, 1.6 to 5.0% Co, 0.001 to 0.020% boron, 0.005 to 0.040% nitrogen, not more than 0.010% oxygen and not more than 0.00020% hydrogen.

2. A steam turbine rotor shaft which is made or a heat resisting martensitic steel whose metal structure is entirely martensite phase produced by tempering after quenching, wherein said heat resisting steel comprises, by weight, 0.05 to 0.20% C, not more than 0.10% Si, from more than 0.15 to 0.85% Mn, not more than 0.10% Ni, 8.5 to 13.0% Cr, not more than 3.50% Mo, not more than 3.5% W, 0.05 to 0.30% V, 0.01 to 0.20% Nb, 1.6 to 5.0% Co, 0.001 to 0.020% boron, 0.005 to 0.040% nitrogen, not more than 0.010% oxygen and not more than 0.00020% hydrogen.

3. A heat resisting steel whose metal structure is entirely martensite phase produced by tempering, and which comprises, by weight, 0.08 to 0.16% C, not more than 0.10% Si, 0.15 to 0.85% Mn, 0.20 to 0.80% Ni, 10.0 to 12.0% Cr, 0.05 to 0.50% Mo, 2.0 to 3.0% W, 0.10 to 0.30% V, 0.03 to 0.10% Nb, 2.0 to 3.5% Co, 0.004 to 0.017% boron, 0.010 to 0.030% nitrogen, 0.0005 to 0.0035% oxygen and 0.00001 to 0.00015% hydrogen.

4. A steam turbine rotor shaft which is made of a heat resisting martensitic steel whose metal structure is entirely martensite phase produced by tempering, wherein said heat resisting steel comprises, by weight, 0.08 to 0.16% C, not more than 0.10% Si, 0.15 to 0.85% Mn, 0.20 to 0.80% Ni, 10.0 to 12.0% Cr, more than 0.50 to 3.5% Mo, 2.0 to 3.0% W, 0.10 to 0.30% V, 0.03 to 0.13% Nb, 2.0 to 3.5% Co, 0.004 to 0.017% boron, 0.010 to 0.030% nitrogen, 0.0005 to 0.0035% oxygen and 0.00001 to 0.00015% hydrogen.

5. A steam turbine rotor shaft according to claim 2, which has 100,000 hours creep rupture strength of not less than 10 $kgf/mm^2$ at 650° C.

6. A heat treatment method for a steam turbine rotor shaft made of the heat resisting steel as defined in claim 1, which comprises the following steps:

quenching a starting material of said rotor shaft from a temperature of 1,000 to 1,100° C.;

tempering the quenched material optionally followed by secondary tempering;

forming a center hole in the tempered material along the axis thereof; and further tempering the material provided with said center hole.

7. A heat resisting steel according to claim 1, wherein a total amount of boron and nitrogen is not more than 0.050% and a ratio of N/B is 1 to 5, where "N" is nitrogen and "B" is boron.

8. A steam turbine rotor shaft according to claim 2, wherein a total amount of boron and nitrogen is not more than 0.050% and a ratio of N/B is 1 to 5, where "N" is nitrogen and "B" is boron.

9. A heat resisting steel according to claim 2, which has a Cr equivalent of not more than 8.5.

10. A steam turbine rotor shaft according to claim 2, wherein said steam turbine is operated under a steam temperature of not lower than 610° C.

11. A heat resisting steel according to claim 1, which has 100,000 hours creep rupture strength of not less than 10 $kgf/mm^2$ at 650° C. and an impact absorption energy of not less that 2 kgf-m at 20° C. after heating for 1,000 hours at 650° C.

12. A steam turbine rotor shaft according to claim 2, wherein said martensitic steel has 100,000 hours creep rupture strength of not less than 10 $kgf/mm^2$ at 650° C. and an impact absorption energy of not less than 2 kgf-m at 20° C. after heating for 1,000 hours at 650° C.

13. A heat resisting steel according to claim 1, which further comprises, by weight, not more than 0.2% in the aggregate of at least one element selected from Ca, Ti, Zr, Ta, Hf, Mg and rare earth elements.

14. A steam turbine rotor shaft according to claim 2, wherein said martensitic steel further comprises, by weight, not more than 0.2% in the aggregate of at least one element selected from Ca, Ti, Zr, Ta, Hf, Mg and rare earth elements.

* * * * *